US006022239A

United States Patent [19]

Wright

[11] Patent Number: 6,022,239

[45] Date of Patent: Feb. 8, 2000

[54] CABLE CONNECTOR ASSEMBLY

[75] Inventor: John O. Wright, York, Pa.

[73] Assignee: Osram Sylvania Inc., Danvers, Mass.

[21] Appl. No.: 08/932,471

[22] Filed: Sep. 18, 1997

[51] Int. Cl.[7] ..... H01R 13/627

[52] U.S. Cl. ..... 439/354; 439/923; 439/607

[58] Field of Search ..... 439/152–160, 439/607, 608, 609, 610, 578, 586, 587, 588, 589, 345, 350–5, 357, 923

[56] References Cited

U.S. PATENT DOCUMENTS 4,526,431 7/1985 Kasukawa ..... 339/45 R
5,041,025 8/1991 Haitmanek ..... 439/681
5,725,395 3/1998 Lee ..... 439/610
5,785,546 7/1998 Hamai et al. ..... 439/354
5,876,230 3/1999 Nishide et al. ..... 439/352

*Primary Examiner*—Lincoln Donovan
*Attorney, Agent, or Firm*—William H. McNeil

[57] ABSTRACT

A cable connector assembly is provided which is particularly useful as a vehicle antenna cable connector. Two mating connectors are provided, one having a male contact and the other having a female contact. A pair of latches is provided which engage one another when the contacts are fully electrically connected. A resilient member is contained in one of the connectors to urge the connectors apart if the connectors are not fully connected and the latches fully engaged.

20 Claims, 5 Drawing Sheets

CABLE CONNECTOR ASSEMBLY

TECHNICAL FIELD

The present invention relates to a cable connector assembly and is particularly useful in connection with an antenna cable connector assembly.

BACKGROUND ART

A typical cable connector assembly such as, without limitation, a cable connector assembly comprising an antenna connector and an antenna cable such as those used in the automobile industry for radios includes a male connector body generally in the form of a plug and a female connector body generally in the form of a ferrule. In use, the male connector body is plugged into the female connector body to effect a mechanical and electrical connection between the two. Typically, an antenna cable in the form of a coaxial cable may be electrically and mechanically attached to one of the connectors such as the male connector, and the other connector, such as the female connector, may be electrically and mechanically attached to another coaxial cable. In some embodiments, the male connector is plugged directly into a radio socket which is electrically and mechanically attached to a circuit such as a circuit on a printed circuit board. In the foregoing prior art devices the lack of satisfactory tactile feedback makes it difficult to know when a suitable connection has been made.

DISCLOSURE OF THE INVENTION

It is an object of the present invention to provide an improved cable connector assembly.

It is another object of the present invention to provide a cable connector assembly which includes a cable connector which provides tactile feedback when coupled to a mating connector.

It is a further object of the present invention to provide a cable connector assembly which includes a cable connector which provides visual feedback when coupled to a mating connector.

Another object of the present invention is to provide a cable connector assembly which allows for force differentiation when connecting mating connectors.

It is yet another object of the invention to obviate the disadvantages of the prior art.

These objects are achieved, in one aspect of the invention, by providing a cable connector assembly, comprising a first parallelepiped connector which includes a first contact, a first latch and a spring member, and a second parallelepiped connector which includes a second contact and a second latch. The first connector and the second connector are constructed and arranged such that in a first mode the first contact is electrically connected to the second contact, the first latch is engaged with the second latch, and the second connector compresses the spring member. In a second mode, the first latch is disengaged from the second latch and the spring member is decompressed urging the second connector away from the first connector and the second contact away from the first contact.

BRIEF DESCRIPTION OF THE DRAWINGS

This invention may be clearly understood by reference to the attached drawings wherein like elements are designated by like reference numerals and in which.

BEST MODE FOR CARRYING OUT THE INVENTION

Figure 1:
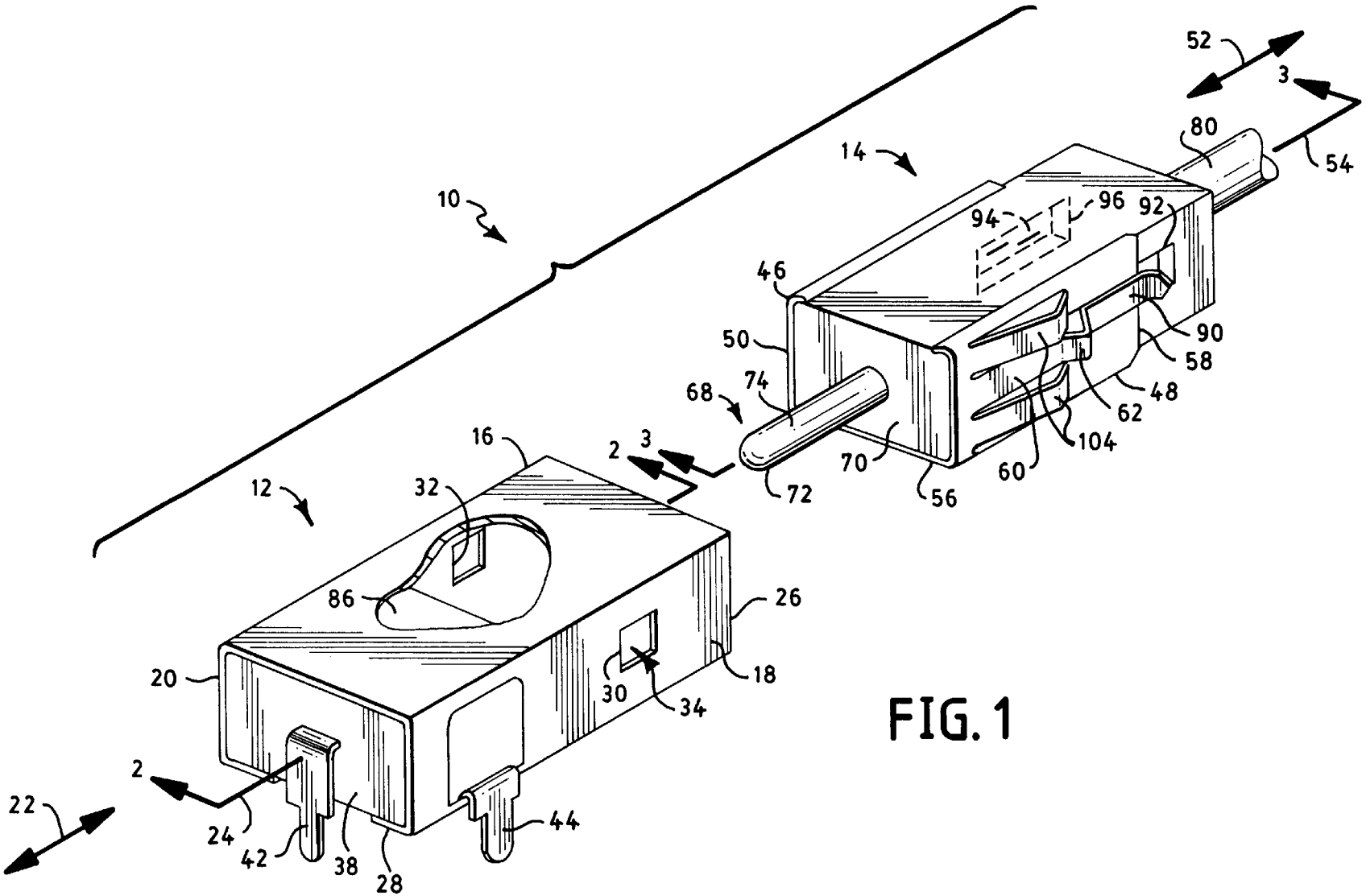
FIG. 1 is an exploded perspective view of one embodiment of the cable connector assembly of the present invention.

For a better understanding of the present invention, together with other and further objects, advantages and capabilities thereof, reference is made to the following disclosure and appended claims taken in conjunction with the above-described drawings.

The embodiment of this invention which is illustrated in the drawings is particularly suited for achieving the objects of this invention.

The cable connector assembly of the present invention includes a first parallelepiped connector having a first contact, a first latch and a spring member, and a second parallelepiped connector having a second contact and a second latch.

Referring now to the drawings with greater particularity, in the embodiment illustrated in FIG. 1, a cable connector assembly 10 is provided which includes a connector 12 and a connector 14.

The connector 12 includes a housing 16 having a side 18 and an opposite side 20 each of which extends in the direction 22 of a longitudinal axis 24 of the connector 12 from an end 26 to an opposite end 28. At least one aperture is provided in the housing 16. In the embodiment illustrated in FIG. 1 there are two apertures. In particular, the side 18 includes an aperture 30 and the side 20 includes an aperture 32. Apertures 30 and 32 extend completely through sides 18 and 20, respectively and open into cavity 34 of the housing.

A contact is attached to the connector 12 and includes a contact engaging surface. For example, in the embodiment illustrated in FIGS. 1 and 2, a contact 36 is contained within cavity 34 of the housing 16 by being mounted within insulative member 38 in a conventional manner. Without limitation, the connector 12 is in the form of a socket, and the contact 36 is a female contact which includes a contact engaging surface 40 and a tab 42. Tab 42 may be electrically and mechanically connected to a circuit, such as a circuit on a printed circuit board (not shown), in a conventional manner. Grounding may be effected by providing a conductive housing 16 and electrically connecting housing 16 to the printed circuit board by a tab 44 of the housing, in a conventional manner.

In the embodiment of the present invention illustrated in FIG. 1, the connector 14 includes a housing 46 having one side 48 and an opposite side 50. Sides 48 and 50 extend in the direction 52 of a longitudinal axis 54 of the connector 14 from one end 56 to an opposite end 58. The connector 14 is provided with at least one resilient leg. In the embodiment illustrated in FIG. 1, the side 48 includes a leg 60 having resiliency and a leg portion 62. Similarly, the side 50 includes a similar leg 64 having resiliency and a similar leg portion 66. Leg 64 and leg portion 66 are not visible in FIG. 1 but are identical to leg 60 and leg portion 62 and are depicted in FIGS. 4–8 discussed hereinafter regarding use of the cable connector assembly 10. Legs 60 and 64 may be integral with the housing 46.

Figure 3:
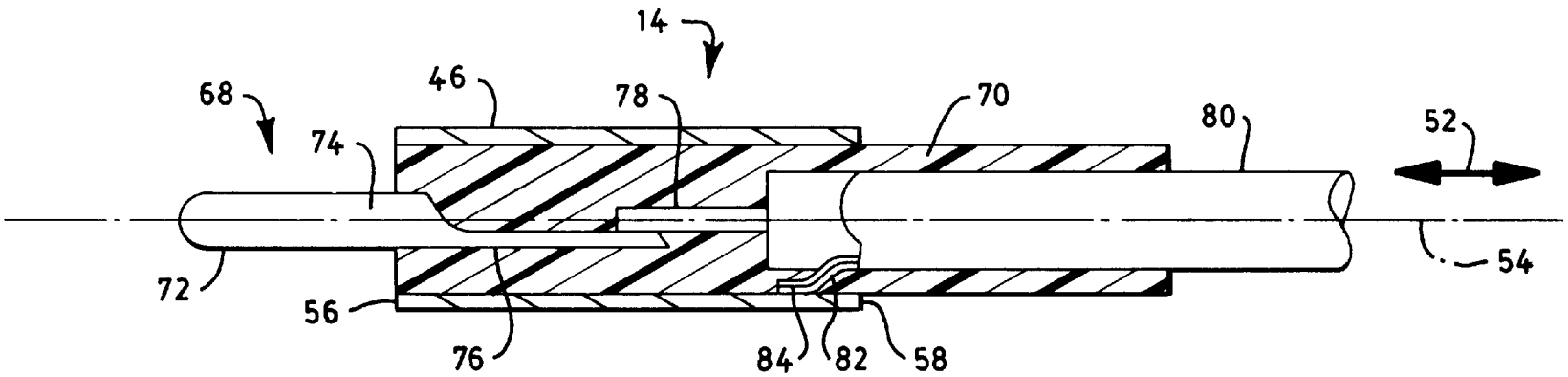
FIG. 3 is a partial cross-sectional view of the connector 14 of FIG. 1 taken along the lines 3—3.

A contact is attached to the connector 14 and includes a contact engaging surface. For example, in the embodiment illustrated in FIG. 3, a contact 68 extends from and is contained within the housing 46 by being mounted within insulative member 70 in a conventional manner. Without limitation, the connector 14 is in the form of a male connector, and the contact 68 is a male contact which includes a prong 72 which provides a contact engaging surface 74. The contact 68 includes a tab 76 which may be electrically and mechanically connected to the central conductor 78 of a coaxial cable 80 in a conventional manner. Similarly, grounding may be effected by providing housing 46 in the form of a conductive shell, the ground wire 82 of the cable 80 being electrically, and mechanically connected to the conductive housing 46 as, for example, by welding at 84.

An elastomeric member is contained in the first connector or the second connector adjacent the first contact or the second contact, respectively. For example, in the embodiment illustrated in FIG. 2, an elastomeric member 86 is contained in the housing 16 of the connector 12. Elastomeric member 86 may be, without limitation, an elastomeric foam block which may be force fit, adhered to or otherwise contained within cavity 34 of housing 16. The elastomeric foam block 86 includes an aperture 88 therethrough adjacent the contact 36, the aperture 88 and the contact 36 having the same longitudinal axis 24.

In the embodiment of FIG. 1, the leg 60 of connector 14 includes a segment 90 which extends from the leg portion 62. Connector 14 also includes a channel 92 adjacent the segment 90. Channel 92 may comprise a cut-out portion of the housing 46 and a cut-out portion of insulative member 70. In a like manner, the leg 64 includes a segment 94, and the connector 14 includes a channel 96. Segment 94 and channel 96 are identical to segment 90 and channel 92, respectively. Segments 90 and 94 are depressible towards the longitudinal axis 54, and channels 92 and 96 are constructed and arranged to receive segments 90 and 94 when such segments are depressed in this manner.

Figure 4:
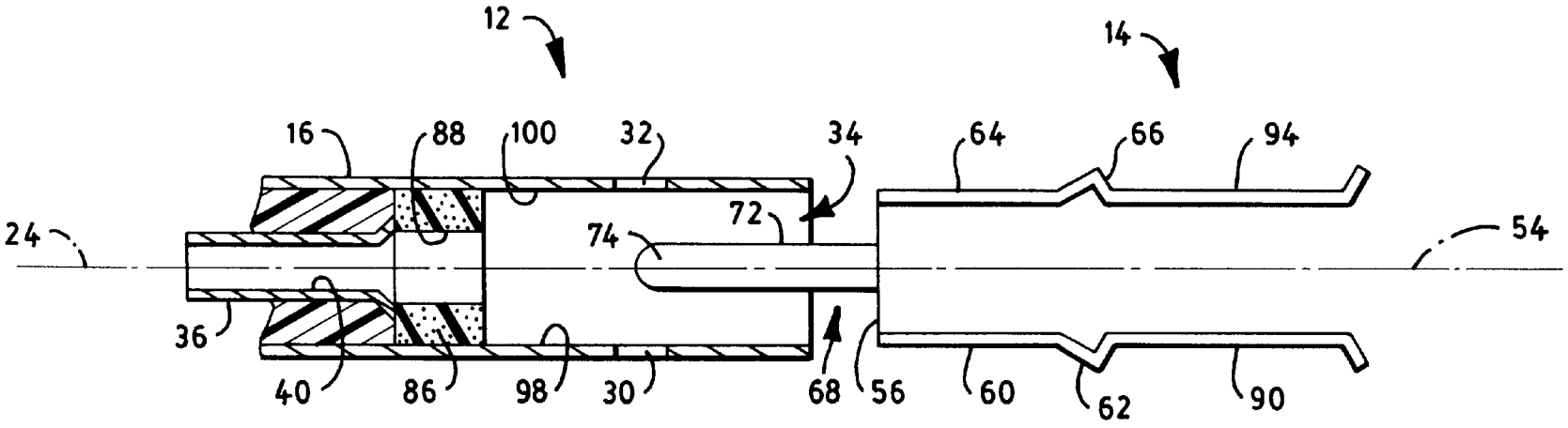
FIGS. 4–8 are plan view diagrammatic representations sequentially illustrating the connection and disconnection of one embodiment of the cable connector assembly of the present invention.
Figure 5:
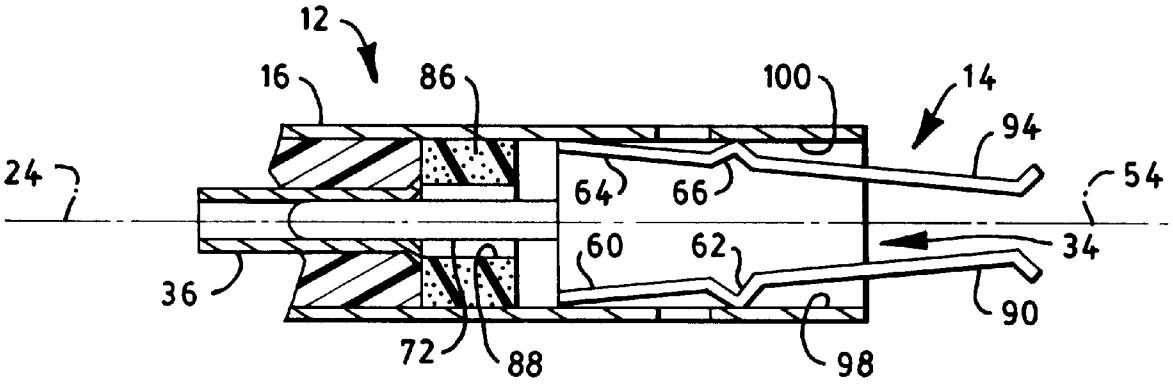
Figure 6:
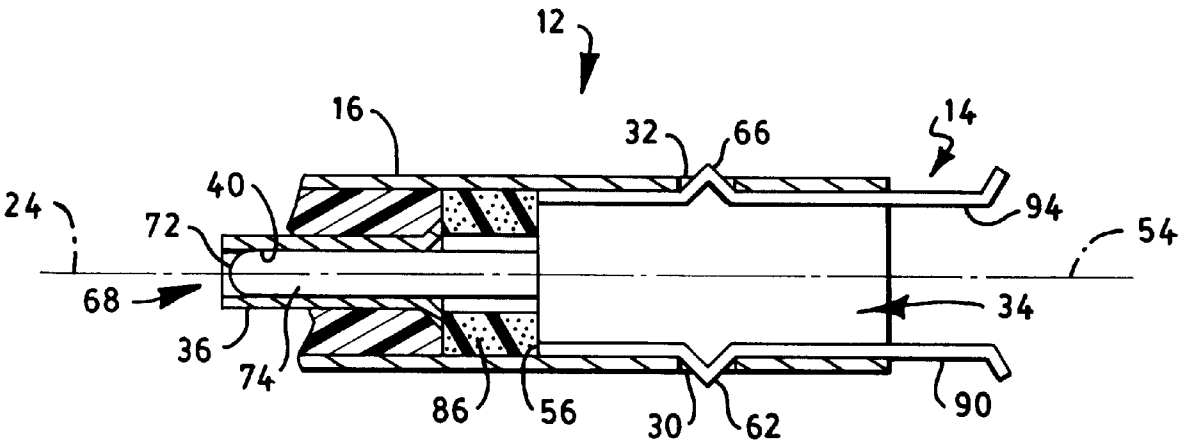

Operation of the cable connector assembly 10 will now be described with reference to FIGS. 4–8. In order to electrically connect the contact engaging surfaces 40 and 74 of contacts 36 and 68, respectively, the connector 14 is first inserted into cavity 34 of connector 12 as illustrated in FIG. 4. To this end connectors 12 and 14 are constructed and arranged to mate with each other and to allow reciprocation of one relative to the other. Continued insertion of the connector 14 into cavity 34 causes the leg portions 62 and 66 or respective opposing resilient legs 60, 64 to engage inner surfaces 98, 100 of the housing 16 thereby camming the legs 60, 64 and respective leg portions 62, 66 towards the longitudinal axis 54 of the connector 14 as illustrated in FIG. 5. During such continued insertion, the prong 72 will be inserted through aperture 88 of the elastomeric foam block 86 and partially inserted into the female contact 36, and the camming of legs 60, 64 will urge segments 90, 94 into respective channels 92, 96. Continued insertion of the connector 14 into the cavity 34 will cause the end 56 of the housing 16 to engage and compress the elastomeric foam block 86 as illustrated in FIG. 6. The connectors 12 and 14 are constructed and arranged such that when the prong 72 is fully inserted into female contact 36 such that contact engaging surfaces 40 and 74 are fully engaged to assure the required electrical connection therebetween, the leg portions 62 and 66 will be aligned with respective apertures 30 and 32, and the resiliency of legs 60 and 64 will thereby urge leg portions 62 and 66 away from each other and the longitudinal axis 54 and into respective apertures 30 and 32, as illustrated in FIG. 6. The connecting together of connectors 12 and 14 as illustrated in FIG. 6 effects a first or engaged mode wherein the contact 68 is fully electrically connected to the contact 36, the latches effected by leg portion 62 and aperture 30 and leg portion 66 and aperture 32 are engaged, and the spring member in the form of the elastomeric foam block 86 is compressed between connectors 12 and 14.

The urging of the leg portions 62 and 66 into respective apertures 30 and 32 provides tactile feedback to the operator confirming complete connection of the connectors 12 and 14. Visual feedback is also provided to the extent that the operator can observe outward movement of the connector 14 relative to the connector 12 caused by decompression of the elastomeric member 86 when the latches 30, 62 and 32, 66 are not fully engaged. The operator will also observe force differentiation to the extent that the elastomeric member 86 will urge connectors 12 and 14 apart during decompression resulting from an incomplete engagement of latches 30, 62 and 32, 66.

Figure 7:
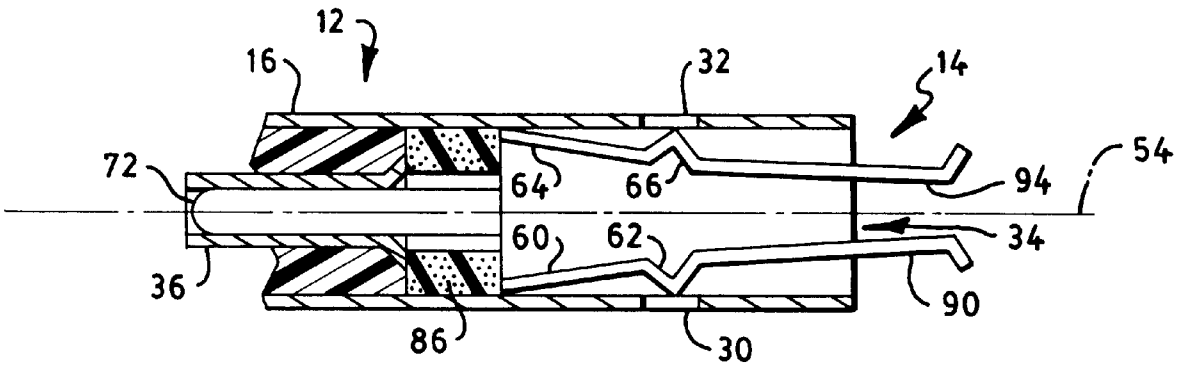
Figure 8:
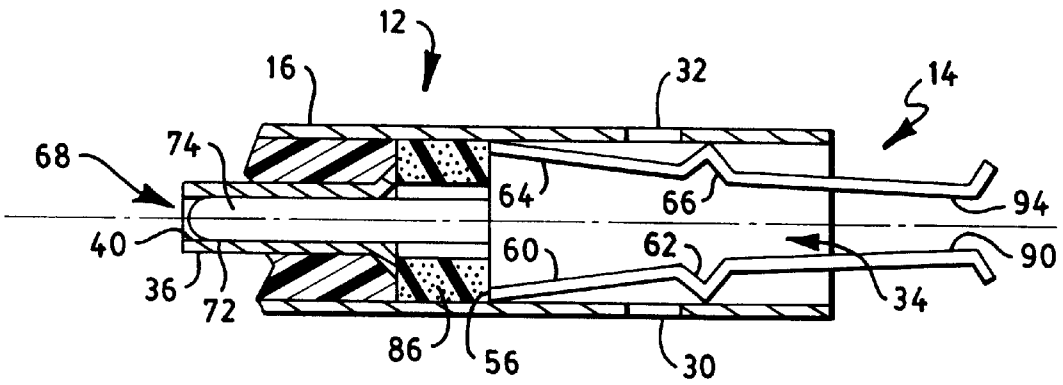

In order to disconnect connectors 12 and 14, the segments 90 and 94 of respective resilient legs 60 and 64 are depressed against their resiliency towards each other and towards the longitudinal axis 54 thereby causing the leg portions 62 and 66 of respective legs 60 and 64 to be removed from respective apertures 30 and 32, as illustrated in FIG. 7. During such depression, segments 90 and 94 will be urged into respective channels of connector 14. The removal of the leg portions 62, 66 from respective apertures 30, 32 essentially unlocks the cable connector assembly. The resiliency of the elastomeric foam block 86 causes it to resume its original non-compressed configuration thereby urging the elastomeric foam block against the end 56 of the housing 14 to urge the connector 14 and contact 68 away from the contact 36 of the connector 12, as illustrated in FIG. 8. The disconnecting of connectors 12 and 14 as illustrated in FIG. 8 effects a second or disengaged mode wherein the latches effected by the leg portion 62 and aperture 30 and leg portion 66 and aperture 32 are disengaged, the spring member in the form of the elastomeric foam block 86 is decompressed urging connector 14 away from connector 12, and the contact 68 is thereby urged away from contact 36. The connectors 12 and 14 may be fully disengaged by removing the housing 46 of connector 14 from the cavity 34 of connector 12.

In the embodiment illustrated in the drawings, the elastomeric member is compressible and decompressible in the direction 22 of the longitudinal axis 24 of the connector 12, and the legs 60 and 64 are moveable towards and away from the longitudinal axis 54 of the connector 14. As further illustrated in the drawings, longitudinal axes 24 and 54 will be substantially the same in the first or engaged mode and the second or disengaged mode of the cable connector assembly 10.

Figure 2:
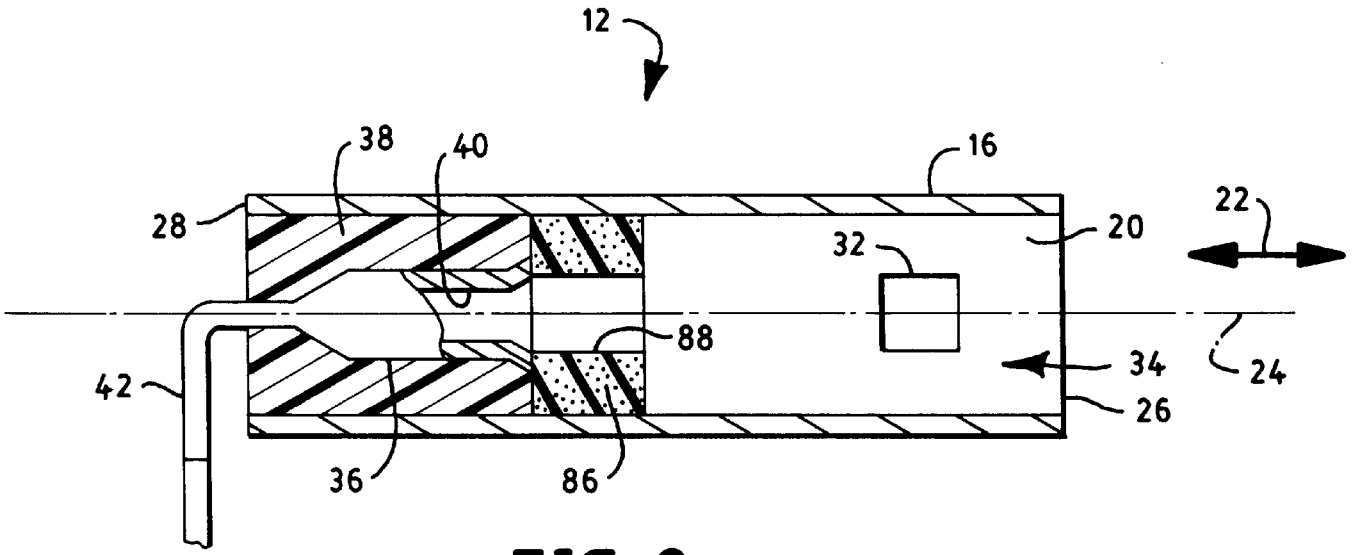
FIG. 2 is a partial cross-sectional view of the connector 12 of FIG. 1 taken along the lines 2—2.

In the embodiment depicted in FIGS. 1 and 2, the connector 12 is in the form of a socket, the contact 36 being electrically and mechanically connected to a printed circuit board (not shown) by tab 42. In an alternative embodiment, connector 12 may be replaced with a conventional female connector which is electrically and mechanically connected to a coaxial cable. For example, in the embodiment illustrated in FIG. 9, a connector 12' replaces connector 12. Connector 12' includes a housing 16' attached to a female connector housing 16" by tabs 102 of housing 16'. Housing 16' includes apertures 30', 32' (only aperture 30' is visible in FIG. 9) similar to apertures 30, 32, a cavity 34' similar to cavity 34 and a spring member such as an elastomeric foam block 86' similar to elastomeric foam block 86. A female contact 36' is provided in female connector housing 16" and may be electrically and mechanically connected to a coaxial cable 80' in the same manner contact 68 is connected to cable 80. Similarly, cable 80' may be grounded in a conventional manner such as the manner illustrated in FIG. 3 for cable 80. The embodiment illustrated in FIG. 9 operates in the same manner as the embodiment illustrated in FIG. 1.

Figure 9:
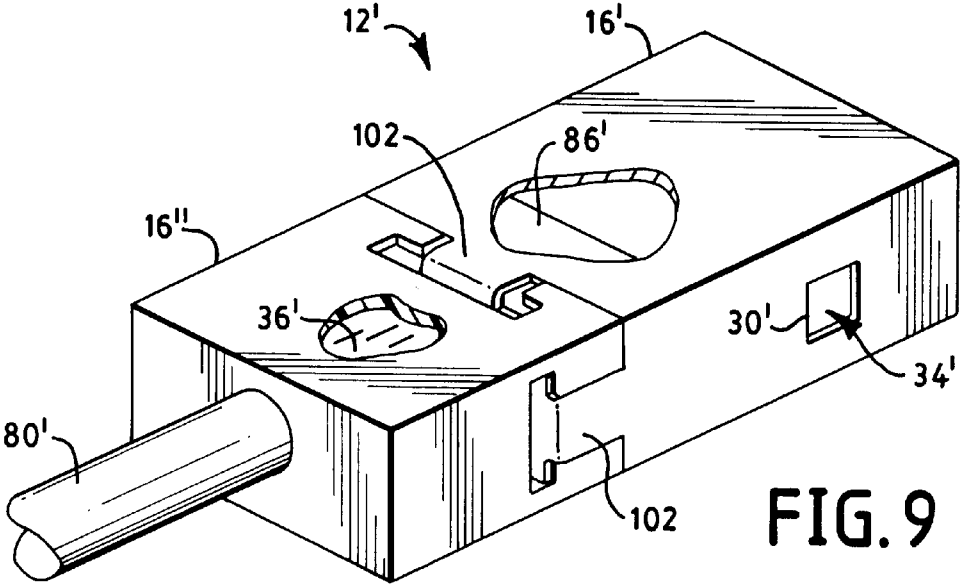
FIG. 9 is a perspective view of a connector of another embodiment of the cable connector assembly of the present invention.

In the embodiments of FIGS. 1 and 9, grounding of the fully connected cable connector assembly may be effected by providing housing 46 of connector 14 with resilient contacts 104 at sides 48, 50. Such contacts 104 may be integral with the housing 46 as illustrated in FIG. 1. Resilient contacts 104 extending from side 50 are not visible in FIG. 1 but are identical to the resilient contacts 104 extending from side 48. When the connector 14 is fully inserted into the cavity 34 or 34' of connectors 12, 12', respectively, the contacts 104 will engage inner surfaces of respective housings 16, 16' which are adjacent contacts 104 to effect the grounding.

Fabrication of the various components described herein may be accomplished using conventional procedures. For example, the insulative members may be molded from a plastic material such as, without limitation, nylon or polypropylene. The conductive housings and the contacts, whether male or female, may be stamped from a metal sheet and then rolled and/or bent if required to form the desired configuration. The elastomeric member may be stamped or otherwise cut from an elastomeric material.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

I claim:

1. A cable connector assembly, comprising;

a first parallelepiped connector comprising a first contact, a first latch and a spring member having an aperture therethrough, and a second parallelepiped connector comprising a second contact and a second latch, said first connector and said second connector being constructed and arranged such that in a first mode said first contact will be electrically connected to said second contact, after said second contact passes through said aperture in said spring member, said first latch will be engaged with said second latch, and said second connector will compress said spring member, and in a second mode said first latch will disengage from said second latch, and said spring member will decompress and urge said second connector away from said first connector and said second contact away from said first contact.

2. The cable connector assembly of claim 1 wherein said first latch comprises at least one aperture extending from an inner surface of said first connector to an outer surface of said first connector, and further wherein said second connector is constructed and arranged to mate with and reciprocate in relation to said first connector, and said second latch comprises at least one leg having resiliency and a leg portion, said leg portion of said at least one leg being (a) resiliently urged into said at least one aperture to engage said first latch with said second latch in said first mode, and (b) urged, against said resiliency, out of said at least one aperture to disengage said first latch from said second latch in said second mode.

3. The cable connector assembly of claim 2 wherein said spring member comprises an elastomeric member contained in said first connector and further wherein said second connector is constructed and arranged to mate within and reciprocate in relation to said first connector to effect compression of said elastomeric member in said first mode and decompression of said elastomeric member in said second mode.

4. The cable connector assembly of claim 3 wherein one of said first connector and said second connector comprises a male contact and the other of said first connector and said second connector comprises a female contact, said first contact and said second contact being constructed and arranged to be electrically and mechanically connected to a respective coaxial cable.

5. The cable connector assembly of claim 3 wherein one of said first connector and said second connector comprises a male contact and the other of said first connector and said second connector comprises a female contact, one of said first contact and said second contact constructed and being arranged to be electrically and mechanically connected to a coaxial cable and the other of said first contact and second contact being constructed and arranged to be electrically and mechanically connected to a circuit.

6. The cable connector assembly of claim 3 wherein said at least one leg includes a segment which extends from said leg portion, said segment being depressible to urge said leg portion against said resiliency and out of said at least one aperture in said second mode.

7. The cable connector assembly of claim 6 wherein said second connector comprises an outer conductive shell.

8. The cable connector assembly of claim 7 wherein said at least one leg comprises a first leg having a first leg portion and a second leg having a second leg portion, said first leg and said second leg being integral with said outer conductive shell, and further wherein said at least one aperture includes a first aperture and a second aperture, said first leg portion and said second leg portion being aligned with said first aperture and said second aperture, respectively, in said first mode.

9. The cable connector assembly of claim 1 wherein:

said first connector and said second connector extend in a first direction;

said first contact and said second contact extend in said first direction;

said spring member is compressed and decompressed in said first direction; and said first latch and said second latch are engaged and disengaged in a second direction transverse to said first direction.

10. The cable connector assembly of claim 2 wherein said second connector comprises at least one channel adjacent said at least one leg, said at least one channel being constructed and arranged to receive said at least one leg.

11. The cable connector assembly of claim 8 wherein said second connector comprises a first channel adjacent said first leg and a second channel adjacent said second leg, said first channel and said second channel being constructed and arranged to receive said first leg and said second leg, respectively.

12. The cable connector assembly of claim 11 wherein said elastomeric member is compressible and decompressible in the direction of a first longitudinal axis of said first connector, and said first leg and said second leg are moveable towards and away from a second longitudinal axis of said second connector and into and out of said first channel and said second channel, respectively, and further wherein in said first mode and said second mode said first axis and said second axis are substantially the same.

13. A cable connector assembly, comprising:

a first connector having a parallelepiped configuration and comprising a first side and an opposite second side extending in the direction of a first longitudinal axis of the first connector from a first end to an opposite second end, said first side having a first aperture and said opposite second side having a second aperture;

a first contact attached to said first connector and having a first contact engaging surface;

a second connector having a parallelepiped configuration and comprising one side and another side opposite said one said extending in the direction of a second longitudinal axis from one end to another end opposite said one end, said one side having a first leg having resiliency and a first leg portion, and said another side having a second leg having resiliency and a second leg portion;

a second contact attached to said second connector and having a second contact engaging surface; and an elastomeric member having an elastomeric member aperture therethrough through which one of said first or second contacts extends when said first and second connectors are mated, contained in one of said first connector adjacent said first contact, and said second connector adjacent said second contact;

said first connector and said second connector being constructed and arranged such that (a) in a first mode said first contact will be electrically connected to said second contact, said first leg portion and said second leg portion will be resiliently urged into said first aperture and said second aperture, respectively, and said elastomeric member will be compressed between said first connector and said second connector, and (b) in a second mode said first leg portion and said second leg portion will be urged out of said first aperture and said second aperture, respectively, and said elastomeric member will be decompressed urging said first connector away from said second connector and said first contact away from said second contact.

14. The cable connector assembly of claim 13 wherein said elastomeric member is contained in said first connector, said first contact is a female contact and said second contact is a male contact.

15. The cable connector assembly of claim 14 wherein said first leg includes a first segment which extends from said first leg portion, and further wherein said second leg includes a second segment which extends from said second leg portion, said first segment and said second segment being depressible towards said second longitudinal axis to urge said first leg portion and said second leg portion against said resiliency and out of said first aperture and said second aperture, respectively, in said second mode.

16. The cable connector assembly of claim 15 wherein said second connector comprises an outer conductive shell, said one side being one side of said outer conductive shell and said another side being another side of said outer conductive shell.

17. The cable connector assembly of claim 16 wherein said second connector comprises a first channel adjacent said first segment and a second channel adjacent said second segment, said first channel and said second channel being constructed and arranged to receive said first segment and said second segment.

18. The cable connector assembly of claim 17 wherein said elastomeric member is compressible and decompressible in the direction of said first longitudinal axis, and said first leg and said second leg are moveable towards and away from said second longitudinal axis and into and out of said first channel and said second channel, respectively, and further wherein in said first mode and said second mode said first axis and said second axis are substantially the same.

19. The cable connector assembly of claim 18 wherein said first contact and said second contact are constructed and arranged to be electrically and mechanically connected to a respective coaxial cable.

20. The cable connector assembly of claim 18 wherein said first contact is constructed and arranged to be electrically and mechanically connected to a circuit and further wherein said second contact is constructed and arranged to be electrically and mechanically connected to a coaxial cable.

* * * * *